US008413457B2

(12) United States Patent
Son et al.

(10) Patent No.: US 8,413,457 B2
(45) Date of Patent: Apr. 9, 2013

(54) REFRIGERATOR AND CONTROL METHOD THEREOF

(75) Inventors: Seok Jun Son, Gwangsan-gu (KR); Young Gwl Park, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 808 days.

(21) Appl. No.: 12/588,216

(22) Filed: Oct. 7, 2009

(65) Prior Publication Data

US 2010/0114378 A1 May 6, 2010

(30) Foreign Application Priority Data

Oct. 30, 2008 (KR) ..... 10-2008-0107222

(51) Int. Cl.
*F25C 1/00* (2006.01)
*F25C 5/02* (2006.01)
*F25B 49/00* (2006.01)

(52) U.S. Cl.
USPC ..... 62/233; 62/71; 62/126

(58) Field of Classification Search ..... 62/71, 126, 62/233, 340, 344; 700/275
See application file for complete search history.

(56) References Cited

FOREIGN PATENT DOCUMENTS

| | | | |
|---|---|---|---|
| KR | 10-1995-0029725 | | 11/1995 |
| KR | 10-2002-0006131 | | 1/2002 |
| KR | 20020006131 A | * | 1/2002 |
| KR | 10-2007-0113053 | | 11/2007 |

* cited by examiner

*Primary Examiner* — Chen Wen Jiang
(74) *Attorney, Agent, or Firm* — Staas & Halsey LLP

(57) ABSTRACT

Disclosed are a refrigerator and a control method thereof, wherein operation of an icemaker can be controlled according to time or function. A sleep mode to control operation of an icemaker according to time is set to prevent generation of noise due to an ice-separating operation implemented at night. In the setting of the sleep mode, a control range of the sleep mode is selected according to a desired operating function (ice-making function or ice-separating function) of the icemaker and also, a period of the sleep mode in units of days/weeks/months (or an operating term) is selected.

18 Claims, 4 Drawing Sheets

REFRIGERATOR AND CONTROL METHOD THEREOF

CROSS-REFERENCE TO RELATED APPLICATIONS

This application claims the benefit of Korean Patent Application No. 2008-0107222, filed on Oct. 30, 2008 in the Korean Intellectual Property Office, the disclosure of which is incorporated herein by reference.

BACKGROUND

1. Field

The present invention relates to a refrigerator and a control method thereof, and, more particularly, to a refrigerator and a control method thereof, wherein operation of an icemaker can be controlled according to time or function.

2. Description of the Related Art

In general, a refrigerator is an apparatus wherein cold air produced via a refrigeration cycle of a refrigerant is fed into food storage compartments, such as a freezing compartment and a refrigerating compartment, to kept food fresh for a long time. With a recent tendency of improving convenience of use and enhancing the quality of products, a refrigerator having an icemaker, which automatically freezes water into ice cubes within the refrigerator, has been introduced.

A conventional icemaker includes an ice-making container in which water is received and is frozen into ice cubes, and a storage container in which the frozen ice cubes are stored. If water is supplied into the ice-making container, the icemaker implements an ice-making operation in which the water is frozen into ice cubes using cold air, and after completion of the ice-making operation, the icemaker implements an ice-separating operation in which the ice-making container is rotated to transfer the frozen ice cubes into the storage container. With the ice-making and ice-separating operations, providing a user with the ice cubes is accomplished.

The ice-making and ice-separating operations of the icemaker are successively implemented until the storage container is filled with an appropriate amount of ice cubes. During implementation of the ice-separating operation, however, transferring the ice cubes into the storage container causes noise.

Another problem of the conventional icemaker is that the icemaker successively implements the ice-making and ice-separating operations regardless of time of day if a deficiency of ice cubes is judged. When the ice-separating operation is implemented at night, a user experiences discomfort and in the worst case, the user's sleep is disturbed. Therefore, conventionally, there has been used a method to control operation of an icemaker using short-cut keys or function keys, which are provided at a front panel of a door to allow a user to select On/Off of the icemaker. However, this conventional method is undesirable in view of convenience of use for eliminating user discomfort and limiting unnecessary operation of the icemaker.

SUMMARY

Therefore, it is an aspect of the present invention to provide a refrigerator and a control method thereof, which can set a sleep mode to control operation of an icemaker according to time, thereby preventing generation of noise due to an ice-separating operation implemented at night.

It is another aspect of the present invention to provide a refrigerator and a control method thereof, which can select a control range of a sleep mode according to a desired operating function (ice-making function or ice-separating function) of an icemaker and also, can select a period of the sleep mode in units of days/weeks/months (or an operating term), thereby preventing unnecessary operation of the icemaker.

Additional aspects and/or advantages of the invention will be set forth in part in the description which follows and, in part, will be apparent from the description, or may be learned by practice of the invention.

Accordingly, it is an aspect of the present invention to provide a refrigerator including: an icemaker; an input unit to set a sleep mode to control operation of the icemaker; and a control unit to control the operation of the icemaker based on set information of the sleep mode.

The refrigerator may further include: a storage unit in which the set information of the sleep mode is stored, and the control unit may read the set information of the sleep mode from the storage unit, to control a sleep-mode operation of the icemaker.

The input unit may select a control time band to operate the icemaker only for a predetermined time and a control period to limit the operation of the icemaker for a predetermined period, so as to set the control time band of the sleep mode on a per period basis.

The input unit may set a control range of the sleep mode, to eliminate an operating function of the icemaker on a per operation basis.

The refrigerator may further include: an output unit to guide a setting procedure of the sleep mode, and the input unit may select the control time band and control period of the sleep mode depending on the guided setting procedure of the sleep mode.

The control unit may limit an operating time of the icemaker based on the control time band of the sleep mode.

The refrigerator may further include: an output unit to guide a setting procedure of the sleep mode, and the input unit may set the control range of the sleep mode depending on the guided setting procedure of the sleep mode.

The control unit may eliminate the operating function of the icemaker based on the control range of the sleep mode.

The control unit may maintain an ice-separating operation of the icemaker in a stand-by status when the control range of the sleep mode is set to eliminate an ice-separating function.

The control unit may maintain an ice-making operation of the icemaker in a stand-by status when the control range of the sleep mode is set to eliminate an ice-making function.

The storage unit may store set information equivalent to the control time band and control range of the sleep mode.

The foregoing and/or other aspects of the present invention may also be achieved by providing a refrigerator including: an icemaker; an input unit to receive a sleep mode of the icemaker from a user; and a control unit to control operation of the icemaker upon input of the sleep mode.

The control unit may provide a function to select an operating time band, control period, or control range of the icemaker upon input of the sleep mode.

The input unit may maintain an ice-making, ice-separating, or water-supply function of the icemaker in a stand-by status on a per operation basis, or receive set information of the sleep mode from the user to enable selection of the function on a per operation basis.

The foregoing and/or other aspects of the present invention may be achieved by providing a control method of a refrigerator having an icemaker including: setting a sleep mode to control operation of the icemaker; storing set information of the sleep mode; and controlling a sleep-mode operation of the icemaker based on the stored set information of the sleep mode.

The control method may further include: guiding a setting procedure of the sleep mode, and the setting of the sleep mode may include selecting a control time band and control period of the sleep mode depending on the guided setting procedure of the sleep mode.

The control of the sleep-mode operation may include limiting an operating time of the icemaker based on the control time band of the sleep mode.

The control method may further include: guiding a setting procedure of the sleep mode, and the setting of the sleep mode may include selecting a control range of the sleep mode according to the guided setting procedure of the sleep mode.

The control of the sleep-mode operation may include limiting an operating function of the icemaker based on the control range of the sleep mode.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
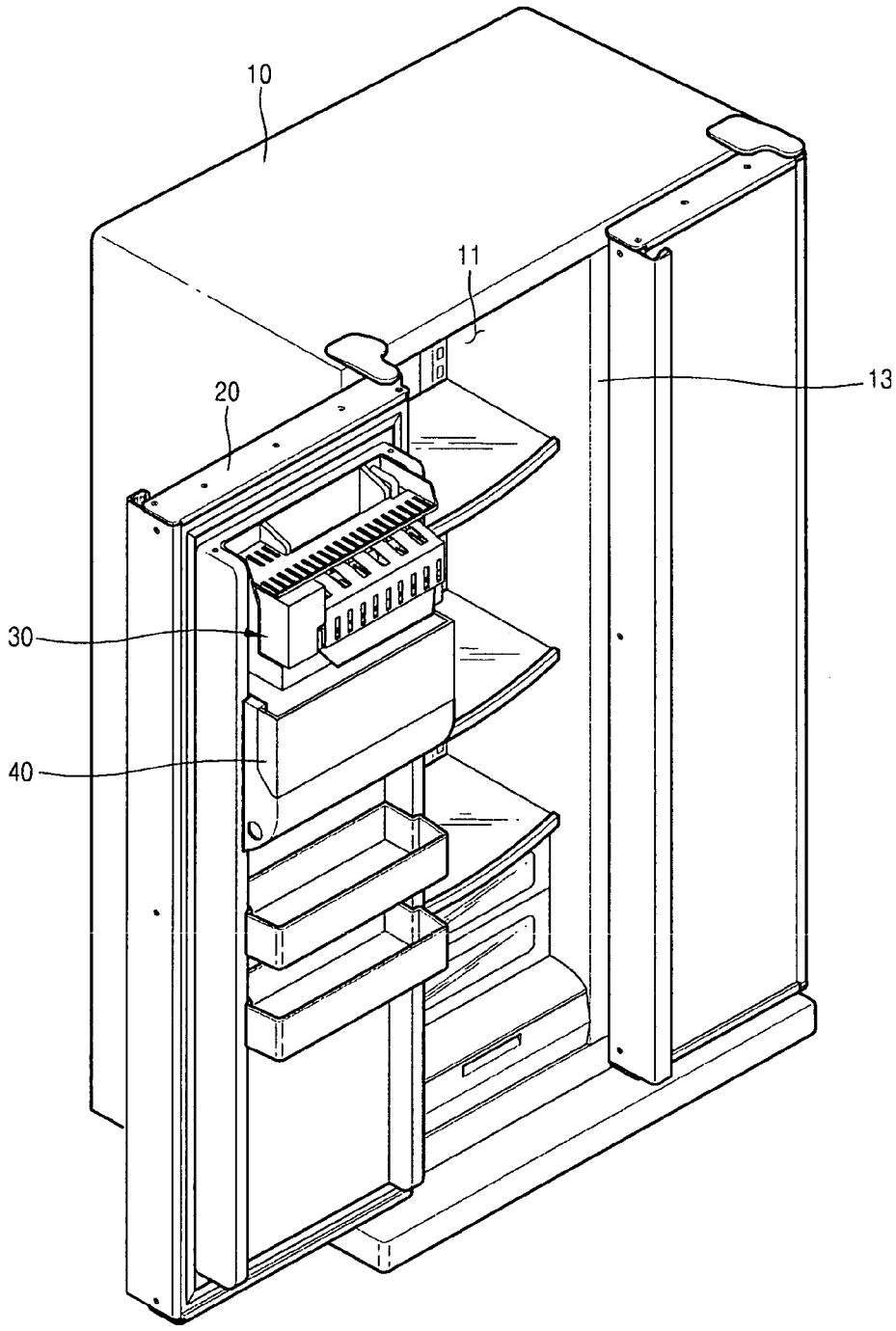
FIG. 1 is a perspective view of a refrigerator according to an exemplary embodiment of the present invention.

Reference will now be made in detail to an exemplary embodiment of the present invention, examples of which are illustrated in the accompanying drawings, wherein like reference numerals refer to like elements throughout. The embodiment is described below to explain the present invention by referring to the figures.

FIG. 1 is a perspective view of a refrigerator according to an exemplary embodiment of the present invention.

As shown in FIG. 1, the refrigerator according to the exemplary embodiment includes a body 10 in which a storage compartment 11 is defined, a door 20 pivotally rotatably coupled to the body 10 to open or close the storage compartment 11, and an icemaker 30 provided at the door 20 to freeze water into ice cubes.

The storage compartment 11 has an open front side, and is divided into left and right sections by a partition 13, the left and right sections being used as refrigerating and freezing compartments, respectively.

Provided below the icemaker 30 is a storage container 40, into which ice cubes made in the icemaker 30 are transferred and stored. Although not shown, the storage container 40 receives a dispenser (not shown) to discharge the stored ice cubes from the front side of the door 20.

The refrigerator according to the exemplary embodiment includes an evaporator, compressor, expander and condenser of a refrigeration cycle. The configuration of the refrigeration cycle is well known and thus, a description thereof will be omitted.

Also, the refrigerator according to the exemplary embodiment may be configured to simultaneously provide a plurality of storage compartments 11 with cold air using a single evaporator, or may be configured to independently provide a plurality of storage compartments 11 with cold air using a plurality of evaporators.

Figure 2:
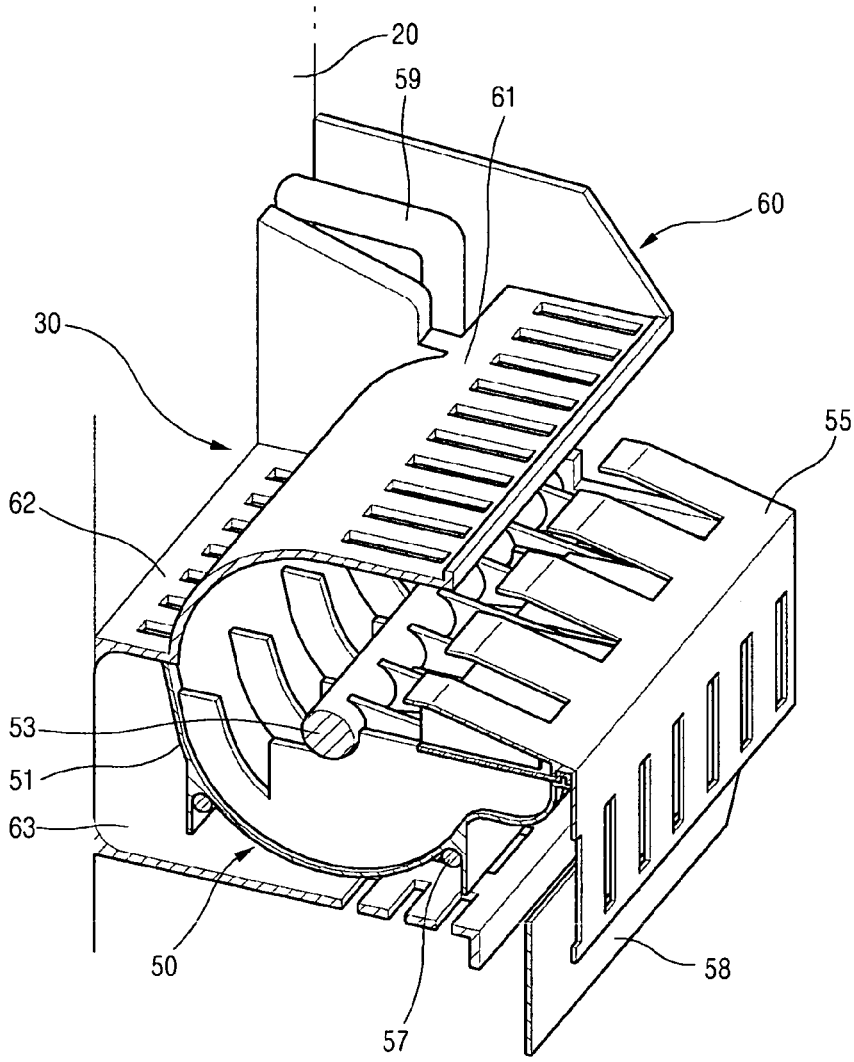
FIG. 2 is a partially cut-away perspective view illustrating an icemaker of the refrigerator according to the exemplary embodiment of the present invention.

FIG. 2 is a partially cut-away perspective view illustrating an icemaker of the refrigerator according to the exemplary embodiment of the present invention.

As shown in FIG. 2, the icemaker 30 according to the exemplary embodiment includes an ice-making unit 50 to freeze water into ice cubes and transfer the ice cubes into the storage container 40, and a cold-air guide unit 60 to guide cold air, required to freeze water into ice cubes, toward the ice-making unit 50.

The ice-making unit 50 includes an ice-making container 51 defining an ice-making space, an ejector 53 to separate and transfer ice cubes from the ice-making container 51 to the storage container 40, and a container cover 55 to guide the ice cubes, separated from the ice-making container 41 under operation of the ejector 53, toward the storage container 40.

A heater 57 is provided beneath the ice-making container 51 and is used to heat the ice-making container 51 to allow the ice cubes to be easily separated from the bottom of the ice-making container 51. The heater 57 is adapted to heat the bottom of the ice-making container 51 before the ejector 53 is operated, enabling easy separation of the ice cubes by the ejector 53.

The cold-air guide unit 60 to guide cold air toward the ice-making unit 50 is configured to enclose the ice-making unit 50 while being coupled to an inner upper position of the door 20.

The cold-air guide unit 60 includes an upper distributor plate 61, a rear distributor plate 62, and a lower distributor plate 63, which are integrally formed with one another. The upper distributor plate 61 allows a part of the supplied cold air to be introduced into the top of the ice-making container 51 while guiding the remaining cold air toward the rear distributor plate 62. The rear distributor plate 62 guides the cold air, guided by the upper distributor plate 61, toward the bottom of the ice-making container 51. The lower distributor plate 63 allows the cold air, introduced toward the bottom of the ice-making container 51 by the rear distributor plate 62, to be moved into the storage container 40 while cooling the ice-making container 51.

An ice-full lever 58 is provided between a front side of the ice-making container 51 and the container cover 55 and is used to sense a storage amount of ice cubes filled in the storage container 40. The ice-full lever 58 is vertically movable in front of the ice-making container 51 to allow the storage container 40 to be filled with an appropriate amount of ice cubes.

The ice-making container 51 is connected at a specific position thereof to a water supply pipe 59 such that water is supplied into the ice-making container 51.

Figure 3:
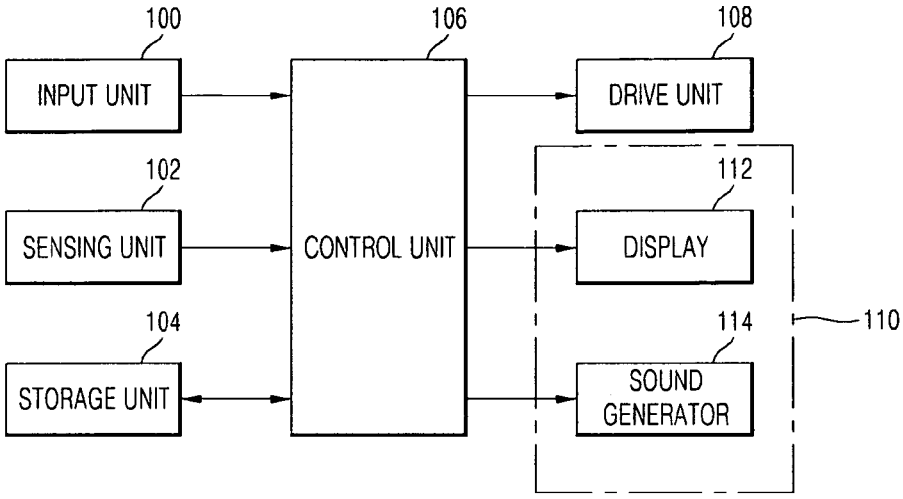
FIG. 3 is a control block diagram of the refrigerator according to the exemplary embodiment of the present invention.

FIG. 3 is a control block diagram of the refrigerator according to the exemplary embodiment of the present invention. A control mechanism of the refrigerator includes an input unit 100, a sensing unit 102, a storage unit 104, a control unit 106, a drive unit 108, and an output unit 110.

The input unit 100 receives user input for setting a variety of functions of the refrigerator (for example, refrigerator cooling functions, and scheduling and timer functions) and a desired mode to control operation of the icemaker 30 (more particularly, a sleep mode to control operation of the icemaker 30 according to time or function). The input unit 100 may include a touch screen, mouse, stylus, button assembly, voice recognizer, etc. provided at the door 20.

The sleep mode is a function to control operation of the icemaker 30 according to time. Specifically, a control time band of the sleep mode can be selected to allow the icemaker 30 to be operated only for a predetermined time each day (for example, a specific night time band from 21:00 to 06:00). Furthermore, as selection of a period (term) in units of days/weeks/months is possible, the sleep mode can be set to operate the icemaker 30 only for a predetermined time band during a period (term) selected by the user.

In the exemplary embodiment, setting of the sleep mode is not limited to selection of the specific time band and also, the control range of the sleep mode can be selected according to an operating function (ice-making or ice-separating function) of the icemaker 30. For example, selecting an ice-separating function as the control range of the sleep mode has an object to eliminate user discomfort due to ice-separating noise and therefore, additional operations subsequent to the ice-separating function can be provided to allow the user to select detailed options, as to the period or set time of the sleep mode, etc. On the other hand, selecting an ice-making function as the control range of the sleep mode can substantially stop operation of the icemaker 30 and therefore, the supply of cold air is implemented only to a level suitable to prevent the ice cubes stored in the storage container 40 from melting without a risk of wasted energy.

The input unit 100 may include an ice-making key or button provided at the front panel of the door 20, to allow the user to easily select the sleep mode to control operation of the icemaker 30. Assuming the use of the ice-making key (or button), if the user pushes the ice-making key once, the icemaker 30 begins an ON mode wherein ice-making, ice-separating and water-supply operations of the icemaker 30 are implemented normally. If the user again pushes the ice-making key (i.e. pushes the ice-making key twice), the icemaker 30 begins an ice-making mode wherein the icemaker 30 is kept to stand by an ice-separating operation and implements only an ice-making operation. Then, if the user again pushes the ice-making key (i.e. pushes the ice-making key three times), the icemaker 30 is changed to an OFF mode wherein the icemaker 30 is kept to stand by both ice-making and ice-separating operations of the icemaker 30. In this way, the icemaker 30 can be changed to various modes via simplified button operation, in consideration of convenience of use.

The sensing unit 102 senses the temperature of the ice-making container 51 and outputs the sensed temperature to the control unit 106, in order to judge whether or not the water supplied into the ice-making container 51 of the icemaker 30 is completely frozen into ice cubes.

The storage unit 104 stores detailed setting information of the sleep mode selected by the user. Specifically, the storage unit 104 stores the control time band (and period) of the sleep mode required to limit the operating time of the icemaker 30 and the control range of the sleep mode required to limit the operating range (ice-separating or ice-making operation) of the icemaker 30.

The control unit 106 is a microprocessor to control general operations of the refrigerator. If the user selects the sleep mode, the control unit 106 reads the control time band and control range of the sleep mode from the storage unit 104, and controls the sleep-mode operation of the icemaker 30 based on the read control time band and control range.

The control unit 106 initiates or changes the sleep-mode operation of the icemaker 30 according to the detailed setting information of the sleep mode selected via the input unit 100. In this case, the control unit 106 allows the detailed setting information of the selected sleep mode to be stored in the storage unit 104, so as to control the sleep-mode operation of the icemaker 30, if necessary.

The drive unit 108 operates respective drive elements (for example, a water supply valve, heater, ice-separating motor, and other peripheral elements) such that the water-supply, ice-making and ice-separating operations of the icemaker 30 can be implemented according to control signals of the control unit 106.

The output unit 110 outputs operating information of the icemaker 30, depending on a variety of functions of the refrigerator and setting information of the sleep mode, upon receiving the control signals of the control unit 106. The output unit 110 includes a display 112 and a sound generator 114. Here, the display 112 is able to provide guide information for setting of the sleep mode and implementation information of to the sleep mode using text or icons. The sound generator 114 is able to provide the above information using sound (bell sound or melody).

Hereinafter, the refrigerator having the above-described configuration and operating sequence and effects of a control method thereof will be described.

If the refrigerator is turned on and operation of the icemaker 30 is initiated, water is supplied into the ice-making container 51 through the water supply pipe 59. The water, supplied into the ice-making container 51, is frozen by cold air directed toward the ice-making container 51 via the cold-air guide unit 60, enabling implementation of an ice-making operation to freeze the water into ice cubes. After the ice-making operation is completed over a predetermined time, the ice-making container 51 is rotated by operation of the ejector 53, enabling implementation of an ice-separating operation to separate and transfer the ice cubes from the ice-making container 51 into the storage container 40.

The ice-making device 30 successively performs ice-making and ice-separating functions until the storage container 40 is filled with an appropriate amount of ice cubes. During implementation of the ice-separating function to transfer the ice cubes into the storage container 40, generation of noise is inevitable.

Therefore, the exemplary embodiment needs a control operation to eliminate user discomfort due to operational noise, more particularly ice-separating noise of the icemaker 30. This will be described hereinafter with reference to FIG. 4.

Figure 4:
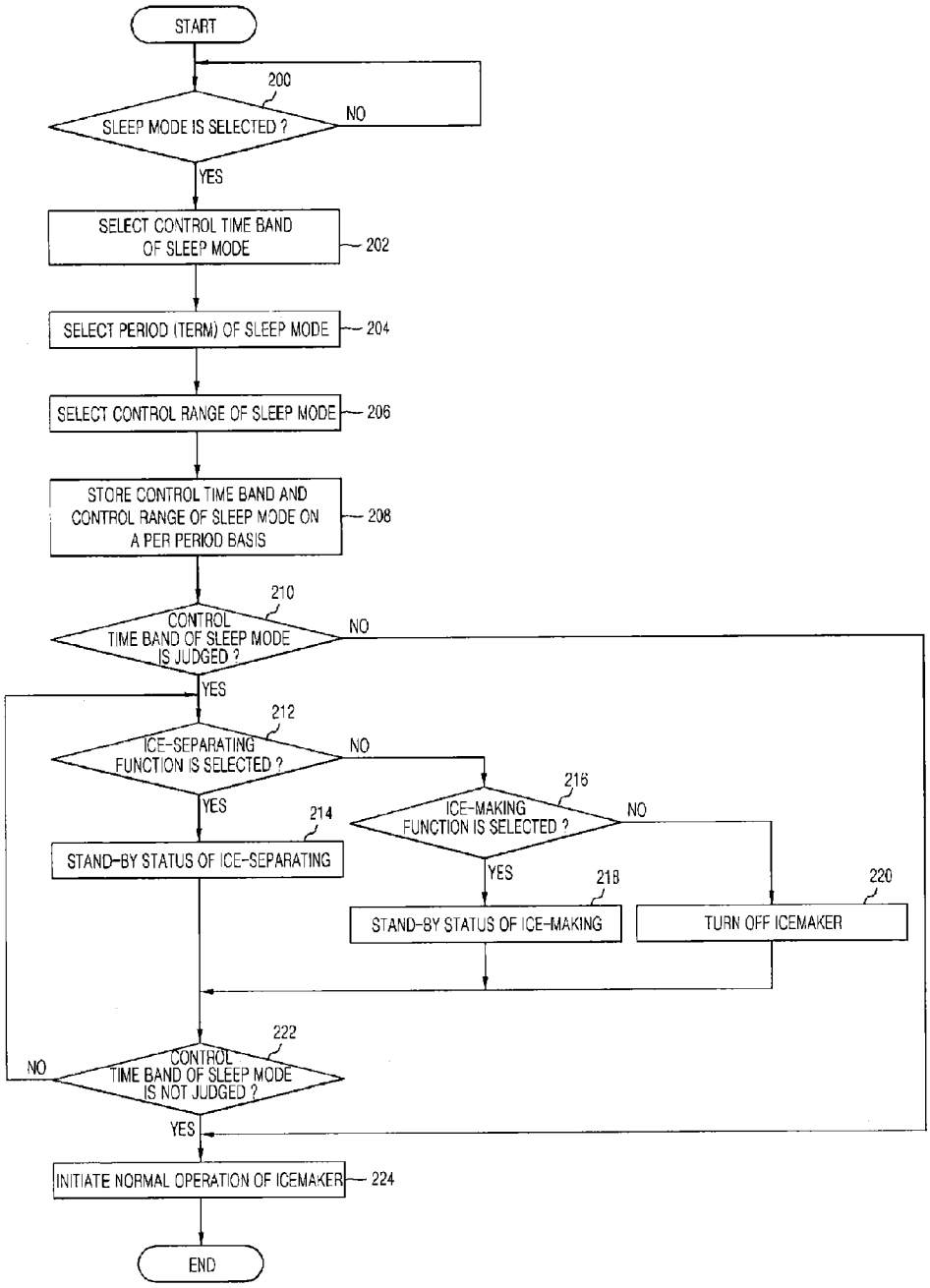
FIG. 4 is a flow chart illustrating an operating sequence of a control method of the refrigerator according to the exemplary embodiment of the present invention.

FIG. 4 is a flow chart illustrating an operating sequence of a control method of the refrigerator according to the exemplary embodiment of the present invention.

In FIG. 4, if the user selects the sleep mode using the ice-making key or button provided at the door 20 of the refrigerator (200), the display 112 outputs a screen, which allows the user to select a specific control time band of the sleep mode (for example, a specific night time from 21:00 to 06.00) so as to operate the icemaker 30 only for a predetermined time each day.

Once the user selects the control time band of the sleep mode from the given screen (202), the display 112 outputs a screen, which allows the user to select a period of the sleep mode (for example, period in units of days/weeks/months) so as to limit operation of the icemaker 30 for a predetermined period.

Then, once the user selects the period of the sleep mode from the given screen (204), the display 112 outputs a screen, which allows the user to select a control range of the sleep mode according to a desired operating function (ice-making or ice-separating function) of the icemaker 30.

Subsequently, once the user selects the control range of the sleep mode from the given screen (206), the control unit 106 sets and stores the control time band and control range of the sleep mode in the storage unit 104, to operate the icemaker 30 only for a predetermined time band each day during the selected period (term) (208).

Here, note that setting of the control time band and control range of the sleep mode on a per period basis may be accomplished using a switch or button, or using a rotating knob that is mechanically operated by a timer, rather than using the display 112.

Thereafter, the control unit 106 reads the control time band of the sleep mode on a per period basis that is stored in the storage unit 104, to judge whether or not a current time is within the control time band of the sleep mode (210). If the control time band of the sleep mode is judged, the control unit 106 judges whether or not the selected control range of the sleep mode is an ice-separating function (212).

If selection of the ice-separating function is judged from the result of the operation 212, the control unit 106 maintains a stand-by status for the ice-separating function, to prevent the ice-making container 51 from implementing the ice-separating operation (214).

Otherwise, if the result of the operation 212 indicates that the ice-separating function is not selected, the control unit 106 judges whether or not the selected control range of the sleep mode is an ice-making function (216). If selection of the ice-making function is judged, the control unit 106 maintains a stand-by status for the ice-making function, to substantially stop operation of the icemaker 30 while enabling the supply of cold air required to prevent ice cubes stored in the storage container 40 from melting without a risk of wasted energy (218).

If the result of the operation 216 indicates that the ice-making function is not selected, the control unit 106 completely stops operation of the icemaker 30 and turns off the icemaker 30 as with a conventional control method (220).

As described above, operation of the icemaker 30 can be controlled based on the control time band and control range of the sleep mode on a per period basis, which are set according to detailed setting information of the sleep mode, resulting in an improvement in convenience of use of the icemaker 30 without causing user discomfort at night due to ice-separating noise.

If the control time band has ended during the controlled operation of the icemaker 30 based on the control time band and time range of the sleep mode on a per period basis, the control unit 106 judges whether or not a current time is within the control time band of the sleep mode (222). If the control time band of the sleep mode is judged, the control operation is returned to the operation 212, enabling repetitive implementation of the above-described operations subsequent to the operation 212.

If the result of the operation 222 indicates that the control time band of the sleep mode has ended, the control unit 106 normally initiates successive water-supply, ice-making and ice-separating functions of the icemaker 30 until the storage container 40 is filled with an appropriate amount of ice cubes (224).

As is apparent from the above description, according to the above-described exemplary embodiment, a sleep mode to control operation of an icemaker according to time can be set so as to prevent generation of noise due to an ice-separating operation implemented at night. Further, in the setting of the sleep mode, a control range of the sleep mode can be set according to a desired operating function (ice-making function or ice-separating function) of the icemaker and also, a period of the sleep mode in units of days/weeks/months (or an operating term) can be set. This has the effect of preventing unnecessary operation of the icemaker, resulting in an improvement in convenience of use.

Although an exemplary embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

an icemaker;

an input unit to receive set information of a sleep mode to control operation of the icemaker; and a control unit to control the operation of the icemaker based on set information of the sleep mode, wherein the set information comprises time band to operate the icemaker only for a predetermined time and a control period to limit the operation of the icemaker for a predetermined period, so as to set the control time band of the sleep mode on a per period basis.

2. The refrigerator according to claim 1, further comprising:

a storage unit in which the set information of the sleep mode is stored, wherein the control unit reads the set information of the sleep mode from the storage unit, to control a sleep-mode operation of the icemaker.

3. The refrigerator according to claim 1, wherein the set information comprises a control range of the sleep mode, to eliminate an operating function of the icemaker on a per operation basis.

4. The refrigerator according to claim 1, further comprising:

an output unit to guide a setting procedure of the sleep mode.

5. The refrigerator according to claim 4, wherein the control unit limits an operating time of the icemaker based on the control time band of the sleep mode.

6. The refrigerator according to claim 4, wherein the control unit eliminates the operating function of the icemaker based on the control range of the sleep mode.

7. The refrigerator according to claim 6, wherein the control unit maintains an ice-separating operation of the icemaker in a stand-by status when the control range of the sleep mode is set to eliminate an ice-separating function.

8. The refrigerator according to claim 6, wherein the control unit maintains an ice-making operation of the icemaker in a stand-by status when the control range of the sleep mode is set to eliminate an ice-making function.

9. The refrigerator according to claim 4, wherein the storage unit stores set information equivalent to the control time band and control range of the sleep mode.

10. A refrigerator comprising:

an icemaker;

an input unit to select a sleep mode of the icemaker and receive set information of the sleep mode from a user; and a control unit to control operation of the icemaker based on selection of the sleep mode, wherein the set information comprises an operating time band, control period, and control range of the icemaker.

11. The refrigerator according to claim 10, wherein the input part maintains an ice-making, ice-separating, or water-supply function of the icemaker in a stand-by status on a per operation basis, or receives set information of the sleep mode from the user to enable selection of the function on a per operation basis.

12. A control method of a refrigerator having an icemaker, the method comprising:

receiving set information of a sleep mode to control operation of the icemaker;

storing set information of the sleep mode; and controlling a sleep-mode operation of the icemaker based on the stored set information of the sleep mode, wherein the set information comprises time band to operate the icemaker only for a predetermined time and a control period to limit the operation of the icemaker for a predetermined period, so as to set the control time band of the sleep mode on a per period basis.

13. The control method according to claim 12, further comprising:

guiding a setting procedure of the sleep mode.

14. The control method according to claim 13, wherein the control of the sleep-mode operation includes limiting an operating time of the icemaker based on the control time band of the sleep mode.

15. The control method according to claim 13, wherein the set information further comprises a control range of the sleep mode, to eliminate an operation function of the icemaker on a per operation basis.

16. The control method according to claim 15, wherein the control of the sleep-mode operation includes limiting an operating function of the icemaker based on the control range of the sleep mode.

17. The control method according to claim 16, wherein the control of the sleep-mode operation includes maintaining an ice-separating operation of the icemaker in a stand-by status when the control range of the sleep mode is set to eliminate an ice-separating function.

18. The control method according to claim 16, wherein the control of the sleep-mode operation includes maintaining an ice-making operation of the icemaker in a stand-by status when the control range of the sleep mode is set to eliminate an ice-making function.

* * * * *

UNITED STATES PATENT AND TRADEMARK OFFICE

CERTIFICATE OF CORRECTION

PATENT NO. : 8,413,457 B2
APPLICATION NO. : 12/588216
DATED : April 9, 2013
INVENTOR(S) : Seok Jun Son et al.

It is certified that error appears in the above-identified patent and that said Letters Patent is hereby corrected as shown below:

In the Claims

Line 4, Column 9, In Claim 12, after “mode;” delete “and”.

Signed and Sealed this
Fifteenth Day of October, 2013

Teresa Stanek Rea
*Deputy Director of the United States Patent and Trademark Office*